United States Patent [19]

Ammon

[11] Patent Number: 4,589,655

[45] Date of Patent: May 20, 1986

[54] WRIST AND FOREARM EXERCISE APPARATUS

[76] Inventor: David Ammon, 1115 Park Willow Ct., Milpitas, Calif. 95035

[21] Appl. No.: 657,981

[22] Filed: Oct. 5, 1984

[51] Int. Cl.[4] ..... A63B 5/00

[52] U.S. Cl. ..... 272/67; 272/142

[58] Field of Search ..... 272/67, 901, 68, 119, 272/135, 141, 142, 143, 130; 128/25 R, 26, 94

[56] References Cited

U.S. PATENT DOCUMENTS

D. 256,822 9/1980 Ozzimo ..... 272/901

1,340,630 5/1920 Maddox ..... 128/94

4,310,154 1/1982 Kauffman ..... 272/67

*Primary Examiner*—Richard J. Apley

*Assistant Examiner*—James Prizant

*Attorney, Agent, or Firm*—Paul L. Hickman

[57] ABSTRACT

A wrist and forearm exercising device is characterized by an elongated frame having two oppositely extending, arcuate members which engage the forearm near the wrist and elbow, respectively. A grip assembly is pivotably attached to the front of the frame, and a tensioning assembly is attached to the frame and to the grip assembly to provide spring tension on the grip assembly. The wrist and forearm is exercised by repeatedly pivoting the grip assembly against spring pressure.

17 Claims, 8 Drawing Figures

FIG-2-
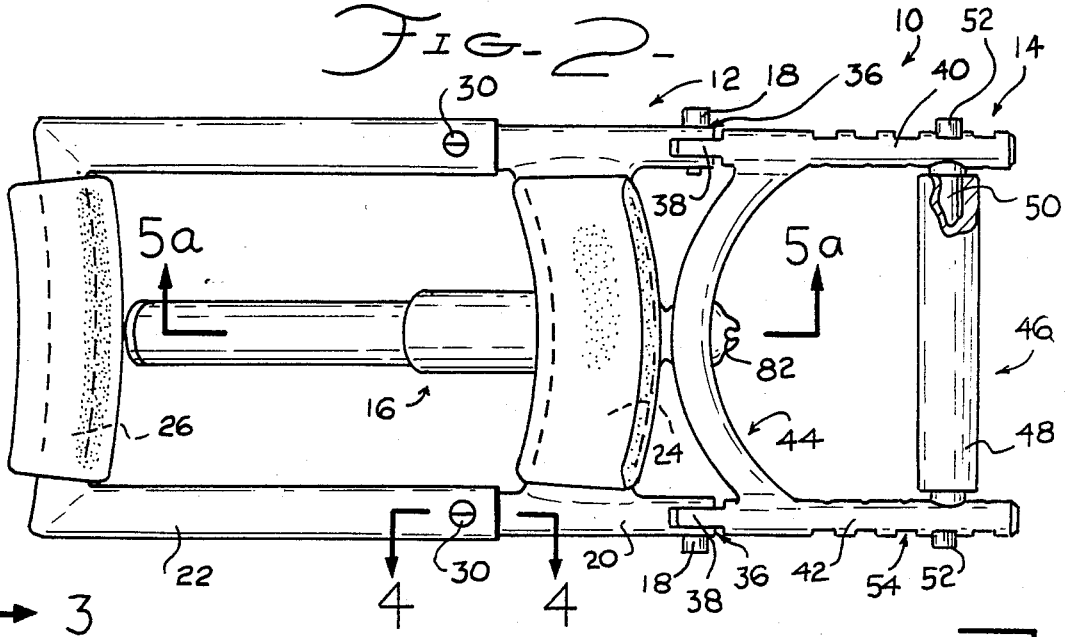
FIG-1-
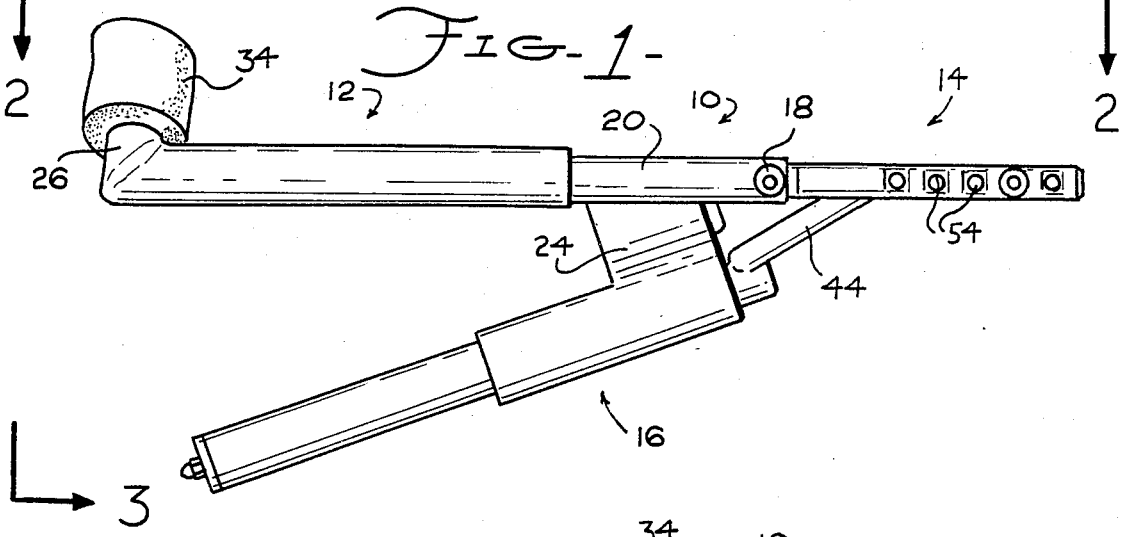
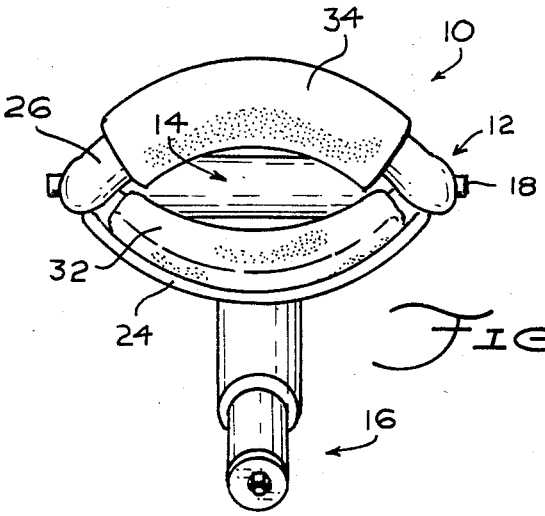
FIG-3-

WRIST AND FOREARM EXERCISE APPARATUS

BACKGROUND OF THE INVENTION

1. Field of the Invention

This information relates generally to exercise apparatus, and more particularly to exercise apparatus for strengthening the arms, fingers, and wrists.

2. Description of the Prior Art

The prior art teaches a number of devices for exercising the wrist and/or forearm. For example, in U.S. Pat. No. 4,039,183 of Sakurada, a device for exercising and strengthening the human wrist is disclosed which includes a concave member having two parallel, spaced members projecting from one thereof, and a grip rotatably mounted between the ends of the spaced members. Springs provide a force which rotate the grip away from the longitudinal axis of the concave member. The device fits upon a user's forearm directly above the wrist and provides wrist strengthening exercises.

In U.S. Pat. No. 440,837 of Bonelli, an exercising device for musicians is taught including an elongated lever pivotally attached to one end of the base and provided with a grip at its other end. A musician rests his arm against a support plate positioned above the elongated lever, and exercises his fingers and wrist by pressing upwardly on the grip to raise the lever against spring pressure.

U.S. Pat. No. 4,310,154 of Kauffman teaches a device for exercising the fingers, wrist, and forearm including an elongated, rigid body member arranged to receive a person's wrist and at least a portion of the forearm. A grip member is pivotally attached to the front of the body member and is urged to an upward angular position with relation to the body member by springs. A pair of straps are used to attach the body member to the user's forearm so that the fingers, wrist, and forearm may be exercised by repeatedly pivoting the grip member against the spring pressure.

It is desirable to be able to conveniently vary the force exerted by the springs of an exercise device so that as the user's strength increases, the resistance force may likewise be increased. Unfortunately, in the prior art the spring force of forearm and wrist exercisers has been difficult or impossible to increase.

Furthermore, most wrist and forearm exercisers of the prior art utilize two springs (i.e. one for each leg of a pivoting grip member) which creates problems of force equalization between the two springs. For example, if one spring were stronger than the other, the grip would tend to twist rather than smoothly pivot.

SUMMARY OF THE INVENTION

An object of this invention is to provide a wrist and forearm exercise apparatus which is easy to use and adjustable.

Briefly, the invention includes an elongated frame provided with an arcuate member at each end, a grip assembly pivotally attached to one end of the frame, a tensioning assembly attached beneath the frame, and a flexible cable coupling the tensioning assembly to the grip assembly. The arcuate members extend to opposing sides of the frame member such that a person's forearm can be engaged near the wrist by a first arcuate member, and near the elbow by the second arcuate member.

The grip assembly includes a pair of support arms and a rotatable grip adjustably attached between the support arms. The tensioning device preferably includes a base member attached to the frame, an adjustment member engaged with a threaded bore of the base member, and an expansion spring attached at one end to the adjustment member and at its other end to the flexible cable. By rotating the adjustment member, the tension on the expansion spring can be changed to vary the force required to rotate the grip assembly.

An advantage of this invention is that the tension required to rotate the grip assembly is easily varied.

Another advantage of this invention is that a single spring is used as the tensioning means.

Yet another advantage of this invention is that the straps required in prior art devices are not required in this invention due to the location of the arcuate members of the frame.

A still further advantage of this invention is that the frame and grip assembly can be adjusted to fit a particular person's forearm and hand.

These and other objects and advantages of the present invention will no doubt become apparent upon a reading of the following descriptions and a study of the several figures of the drawing.

BRIEF DESCRIPTION OF THE DRAWING

FIG. 1 is a side elevation of a wrist and forearm exercise apparatus in accordance with the present invention;

FIG. 2 is a top plan view taken along line 2—2 of FIG. 1;

FIG. 3 is an end elevation taken along line 3—3 of FIG. 1;

DETAILED DESCRIPTION OF THE PREFERRED EMBODIMENT(S)

Figure 4:
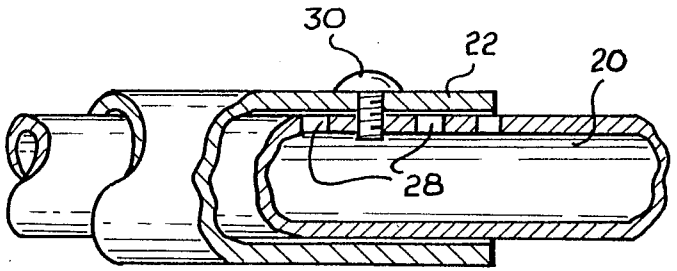
FIG. 4 is a cross-section taken along line 4—4 of FIG. 2.

Referring generally to FIG. 1–3, a wrist and forearm exercise apparatus 10 includes an elongated frame 12, a grip assembly 14, and a tensioning assembly 16. The grip assembly 14 is attached to an end of frame 12 with pivots 18 and is biased to a neutral or extended position by tensioning assembly 16.

As best seen in FIG. 2, frame assembly 12 includes an H-shaped member 20 and a U-shaped member 22. H-shaped member 20 includes a first arcuate member 24, and U-shaped member includes a second arcuate member 26.

Referring additionally to FIG. 4, the tubular legs of H-shaped member 20 are telescopically engaged with the hollow tubular legs of U-shaped member 22. A number of apertures 28 are provided through the walls of tubular H-shaped member 20 and a pair of set screws 30 attaches members 20 and 22 together. By removing set screws 30, the length of frame assembly 12 can be changed to vary the distance between arcuate members 24 and 26.

As best seen in FIG. 3, arcuate member 24 extends below the plane of frame assembly 12, and arcuate member 26 extends above the plane of frame assembly 12. Preferably, a soft, resilient material 32 is applied to an upper surface of arcuate member 24, and a soft resilient tube of material 34 is disposed around arcuate member 26.

The forward ends of H-shaped member 20 are formed into clevis' 36 receptive to a pair of tongues 38 of grip assembly 14. Pivots 18, which preferably are machine bolts, extend through clevis' 36 and tongues 38 to pivotally attach grip assembly 14 to frame assembly 12.

Grip assembly 14 includes a pair of arms 40 and 42, an arcuate bridge 44 attached between arms 40 and 42, and a grip unit 46 also extending between arms 40 and 42. As will be discussed in greater detail with reference to FIGS. 5 and 5*a*, bridge 44 is used to attach the grip assembly 14 to tensioning assembly 16.

Grip unit 46 includes a grip piece 48, and a cylindrical connecting piece 50 which is between to arms 40 and 42 by bolts 52. Grip piece 48 is a hollow, tubular member which may freely rotate around connecting piece 50. Arms 40/42 are provided with a plurality of holes 54 receptive to the shanks of bolts 52. By removing bolts 52, connecting piece 50 can be positioned at various locations along arms 40/42 to vary the distance between grip unit 46 and frame 12.

Figure 5A:
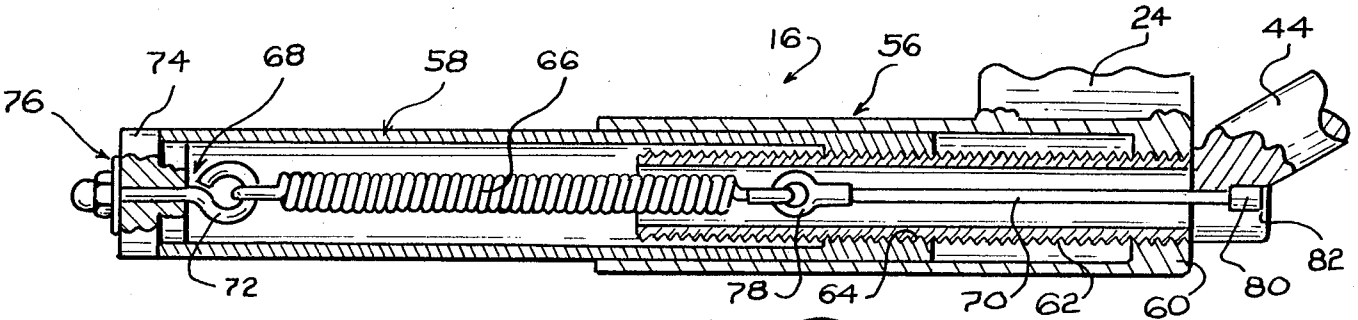
FIG. 5*a* is a cross-section taken along line 5*a*—5*a* of FIG. 2.

Referring more particularly to FIG. 5*a*, the tensioning assembly 16 includes a base member 56 and a adjustment member 58. The base member 56, which preferably is a hollow, tubular member, is attached to the bottom of arcuate member 24 of frame assembly 12. A threaded plug 60 at one end of base member 56 supports an externally threaded core 62.

Adjustment member 58 is also preferably a cylindrical, tubular member, and is provided with an internally threaded section 64 which is engagable with the external threads of core 62. Adjustment member 58 telescopes within base member 56, and may be longitudinally extended therefrom by applying a rotational force to the adjustment member.

A biasing means of the present invention includes an extension spring 66 having a first end coupled to adjustment member 58 by an attachment assembly 68 and having a second end coupled to bridge member 44 by a flexible cable 70. Attachment assembly 68 includes an eye bolt 72, an end plug 74, and a nut and washer 76 attaching eye bolt 72 to end plug 74. The other end of spring 66 attaches to an eye connector 78 which is swaged or otherwise attached to the end of cable 70. The other end of cable 70 is attached to an anchor 80 which engages a slot 82 provided in bridge portion 44.

Figure 5B:
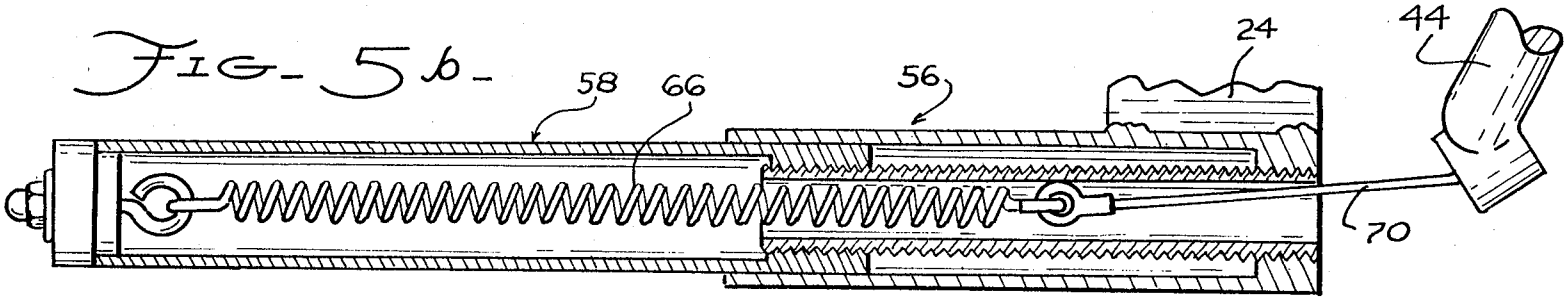
FIG. 5*b* is a cross-section similar to that of FIG. 5*a;*.

Referring now to FIG. 5*b*, adjustment member 58 is shown extended further from base member 56 than was the case in FIG. 5*a*. This, in turn, extends expansion springs 66 to increase the force required to pull on cable 70. Bridge 44 is shown in its partially rotated position due to a rotation of grip assembly 14.

Figure 6:
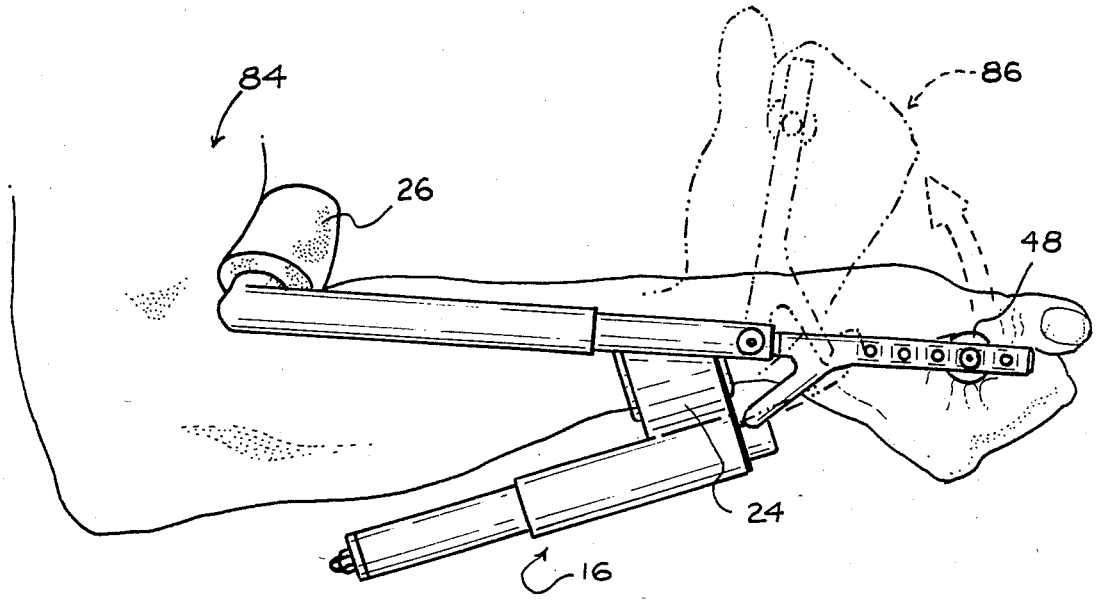
FIGS. 6 and 7 are operational views of the present invention.

Referring now to FIG. 6, a user's arm 84 is engaged with the frame 12 of exercise apparatus 10 with arcuate member 26 positioned near the junction between his forearm and upper arm, and with arcuate member 24 positioned near his wrist. The user then grips grip piece 48 and rotates it to the position shown in broken lines at 86. The tension required for the rotation between the rest position and the position at 86 can be varied by adjusting the spring tension of tensioning assembly 16 as previously explained.

Figure 7:
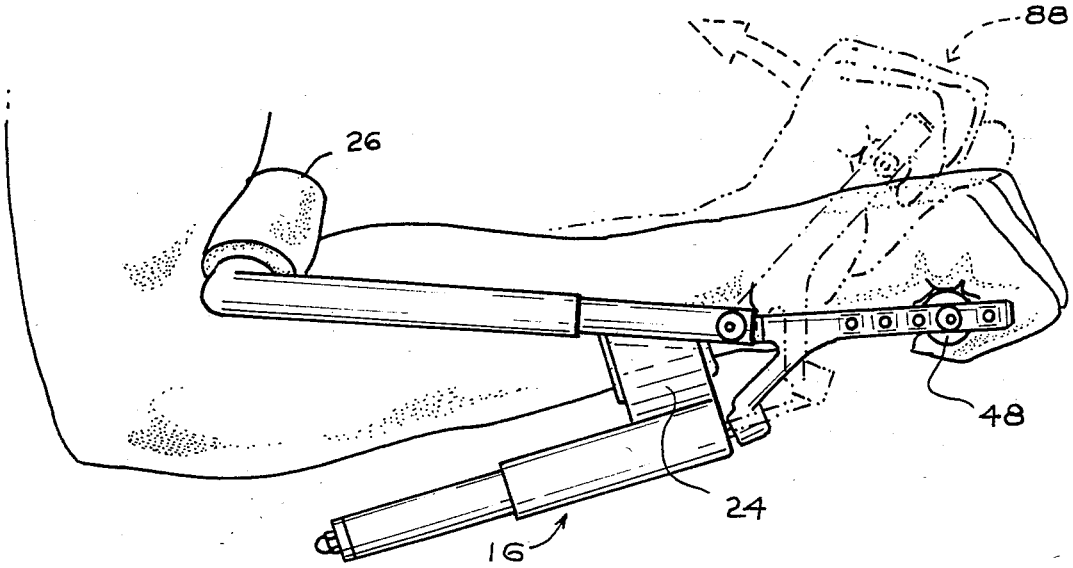

Referring now to FIG. 7, an alternate exercise is shown where arcuate member 26 engages the forearm proximate its juncture to the upper arm, and arcuate member 24 engages the forearm near the wrist. As before, the user grasps grip piece 48 and rotates to the position illustrated in broken lines at 88. Once again, the force required to pivot to this location can be varied with tensioning assembly 16.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A wrist and forearm exercise apparatus comprising:

an elongated frame provided with a first arcuate member proximate a first end thereof, and a second arcuate member proximate a second end thereof, said first arcuate member and said second arcuate member extending in opposite directions from said frame receive a person's forearm, wherein said first arcuate member and said second arcuate member are spaced apart such that said first arcuate member engages said forearm proximate the wrist and said second arcuate member engages said forearm proximate its juncture with the upper arm;

a grip assembly having a first end pivotally attached to said first end of said frame, said grip assembly being provided with a grip unit proximate a second end thereof;

a tensioning assembly including an adjustment member coupled to said frame, and biasing means coupled to said adjustment member, whereby said adjustment member may vary the biasing force exerted by said biasing means, wherein said tensioning assembly further includes a base member coupling said adjustment member to said frame, and wherein said biasing means includes an expansion spring attached at one end to said adjustment member and at its other end to said coupling means; and coupling means for coupling said biasing means to said grip assembly.

2. A wrist and forearm exercise apparatus as recited in claim 1 wherein said grip assembly includes a pair of support arms pivotally attached to said frame, and wherein said grip unit is selectively attachable along the length of said support arms to vary the distance between the grip unit and the frame.

3. A wrist and forearm exercise apparatus as recited in claim 2 wherein said grip unit includes a grip piece provided with a longitudinal bore, and a connecting piece extending through said bore of said grip piece to connect said support arms.

4. A wrist and forearm exercise apparatus as recited in claim 1 wherein said adjustment member is an elongated member which engages said base member such that it is longitudinally extensible from said base member.

5. A wrist and forearm exercise apparatus as recited in claim 4 wherein said base member and said adjustment member are telescopically engaged.

6. A wrist and forearm exercise apparatus as recited in claim 5 wherein said base member includes an outer portion adapted to telescope over an outer surface of said adjustment member; and an inner, threaded core adapted to engage a threaded bore provided within said adjustment member.

7. A wrist and forearm exercise apparatus as recited in claim 1 wherein said frame is longitudinally adjustable to vary the distance between said first arcuate member and said second arcuate member.

8. A wrist and forearm exercise apparatus comprising:

an elongated frame provided with a first arcuate member proximate a first end thereof, and a second arcuate member proximate a second end thereof, said first arcuate member and said second arcuate member extending in opposite directions from said frame receive a person's forearm, said first arcuate member and said second arcuate member being spaced apart such that said first arcuate member engages said forearm proximate the wrist and said second arcuate member engages said forearm proximate its juncture with the upper arm;

a grip assembly having a first end pivotally attached to said first end of said frame, said grip assembly being provided with a grip unit proximate a second end thereof;

a tensioning assembly including an adjustment member coupled to said frame, and biasing means coupled to said adjustment member, whereby said adjustment member may vary the biasing force exerted by said biasing means; and coupling means for coupling said biasing means to said grip assembly, said coupling means including an elongated, flexible member coupled at on end to said biasing means and coupled at its other end to said grip assembly.

9. A wrist and forearm exercise apparatus as recited in claim 8 wherein said grip assembly includes a pair of support arms pivotally attached to said frame, and wherein said grip unit is selectively attachable along the length of said support arms to vary the distance between the grip unit and the frame.

10. A wrist and forearm exercise apparatus as recited in claim 9 wherein said grip unit includes a grip piece provided with a longitudinal bore, and a connecting piece extending through said bore of said grip piece to connect said support arms.

11. A wrist and forearm exercise apparatus as recited in claim 8 wherein said tensioning assembly further includes a base member coupling said adjustment member to said frame, and wherein said biasing means includes an expansion spring attached at one end to said adjustment member and at its other end to said coupling means.

12. A wrist and forearm exercise apparatus as recited in claim 11 wherein said adjustment member is an elongated member which engages said base member such that it is longitudinally extensible from said base member.

13. A wrist and forearm exercise apparatus as recited in claim 12 wherein said base member and said adjustment member are telescopically engaged.

14. A wrist and forearm exercise apparatus as recited in claim 13 wherein said base member includes an outer portion adapted to telescope over an outer surface of said adjustment member; and an inner, threaded core adapted to engage a threaded bore provided within said adjustment member.

15. A wrist and forearm exercise apparatus as recited in claim 8 wherein said frame is longitudinally adjustable to vary the distance between said first arcuate member and said second arcuate member.

16. A wrist and forearm exercise apparatus as recited in claim 8 wherein said biasing means includes an expansion spring coupled at one end to said adjustment member and coupled at its other end to said flexible member.

17. A wrist and forearm exercise apparatus as recited in claim 8 wherein said flexible member is coupled to a bridge member attached to said grip assembly.

* * * * *